US005685324A

United States Patent [19]

Huang

[11] Patent Number: 5,685,324

[45] Date of Patent: Nov. 11, 1997

[54] EYELASH CURLER

[76] Inventor: Chien-Che Huang, 5 F., No. 9-4, Lane 543, Sec. 7, Chang-Lu Rd., Fu-Hsing Hsiang, Chang-Hwa Hsian, Taiwan

[21] Appl. No.: 667,473

[22] Filed: Jun. 21, 1996

[51] Int. Cl.[6] ..... A45D 2/48

[52] U.S. Cl. ..... 132/217; 132/216; 132/218

[58] Field of Search ..... 132/217, 216, 132/218, 213, 223, 53, 313; 401/119, 129

[56] References Cited

U.S. PATENT DOCUMENTS

| | | | |
|---|---|---|---|
| 2,004,046 | 6/1935 | Glaser et al. | 132/217 |
| 2,584,668 | 2/1952 | Brown | 132/217 |
| 3,828,803 | 8/1974 | Windsor | 132/217 |
| 5,097,598 | 3/1992 | Andreula | 30/233 |
| 5,524,649 | 6/1996 | Suh | 132/216 |

*Primary Examiner*—Gene Mancene
*Assistant Examiner*—Pedro Philogene
*Attorney, Agent, or Firm*—Alfred Lei

[57] ABSTRACT

An eyelash curler including a body portion having two opposite shoulders at an upper end thereof, each of the shoulders having an opening, an inverted U-shaped frame having two depending legs and a resilient curved cross bar between upper ends of the legs, each of the legs being provided with a protuberance at a lower end thereof and a groove at an inner side thereof, the protuberance being engaged with the opening, a T-shaped pressing member having a resilient curved rod at an upper portion, the curved rod being provided with a resilient strip at a top thereof and slidably engaged with the groove of the inverted U-shaped frame, a handle having an upper end pivotally connected with a lower end of the T-shaped pressing member, and a spring fitted in the body portion and urging against the handle, and a cover engaged with the body portion end having a pair of upwardly extending arms between which there is a slot for receiving the handle, the handle having a lower end pivotally connected with a bottom of the slot, whereby the eyelash curler can be adapted for use with eyelashes of different curvature.

6 Claims, 5 Drawing Sheets

EYELASH CURLER

BACKGROUND OF THE INVENTION

1. Field of the Invention

This invention is related to an eyelash curler and in particular to one which is fit for use with eyelashes of different curvature.

2. Description of the Prior Art

It has been found that the conventional eyelash curler generally includes a first and second handles 30 pivotally connected to form a scissors mechanism, a V-shaped frame 31 at the upper portion, and a linking member 33 having a pressing strip 34 slidably fitted on the upper ends 32 of the V-shaped frame 31 (see FIG. 9). However, the pressing strip 34 is fixed in curvature and so the manufacturer must fabricate a set of eyelash curlers with pressing strips of different curvature thereby increasing the cost. In addition, the pressing strip 34 must be accurately fitted with the upper ends 32 of the V-shaped frame 31; otherwise, the eyelash will be damaged by the pressing strip 34.

Therefore, it is an object of the present invention to provide an improved eyelash curler which can obviate and mitigate the above-mentioned drawbacks.

SUMMARY OF THE INVENTION

This invention relates to an improved eyelash curler.

It is the primary object of the present invention to provide an eyelash curler which is fit for use with eyelashes of different curvature.

It is another object of the present invention to provide an eyelash curler which is adjustable in curvature.

It is still another object of the present invention to provide an eyelash curler which is simple and sturdy in construction.

It is still another object of the present invention to provide an eyelash curler which is easy and cheap to manufacture.

It is a further object of the present invention to provide an eyelash curler which can be quickly assembled.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
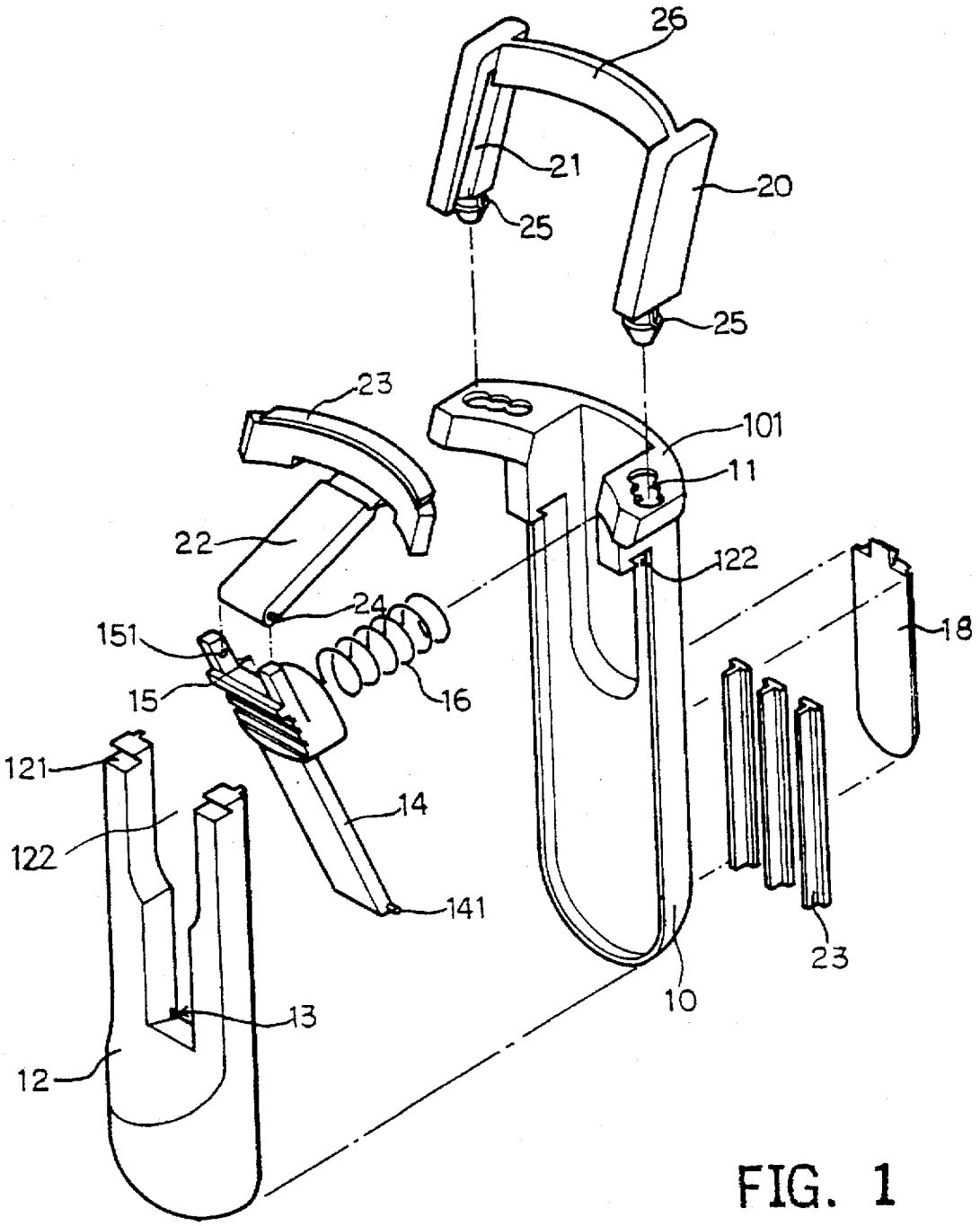
FIG. 1 is an exploded view of an eyelash curler according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
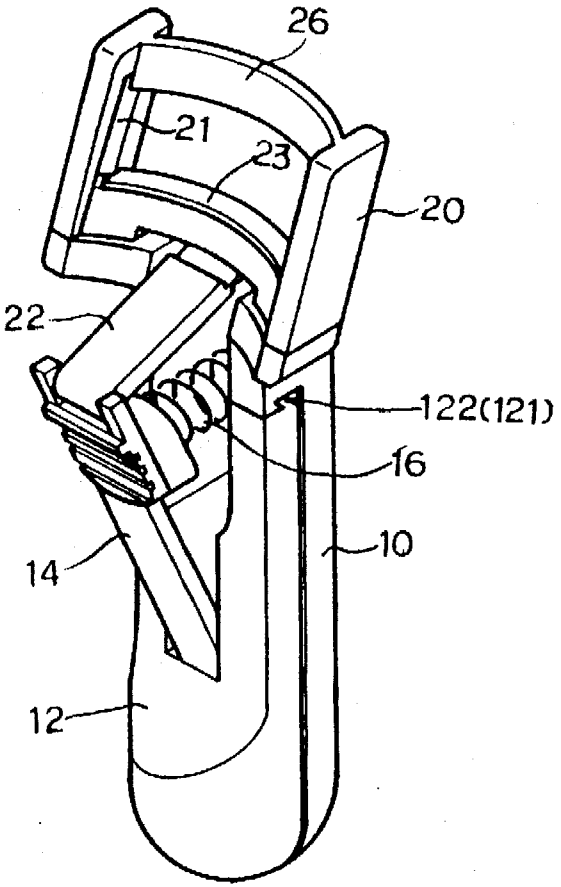
FIG. 2 is a perspective view of the eyelash curler.
Figure 3:
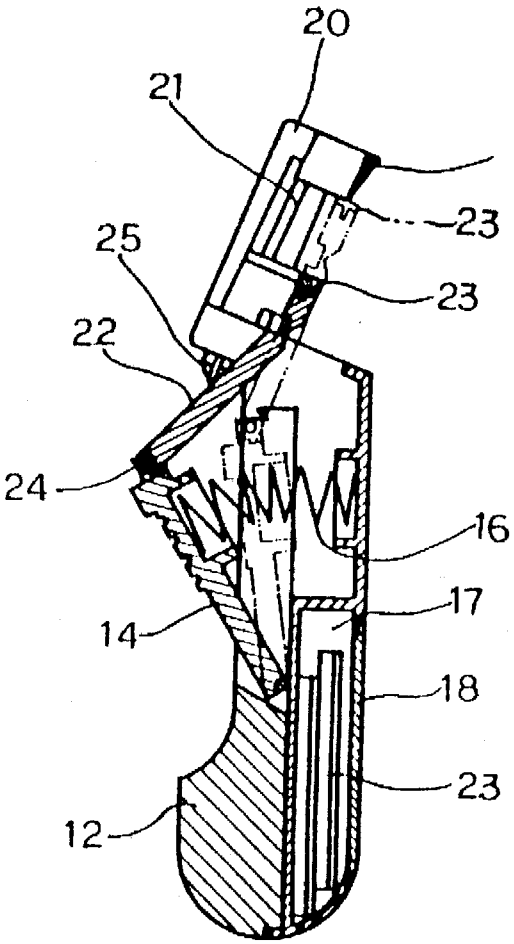
FIG. 3 is a sectional view of the eyelash curler.

With reference to the drawings and in particular to FIGS. 1, 2 and 3 thereof, the eyelash curler according to the present invention comprises a body portion 10 and a cover 12 adapted to engage with the body portion 10. The body portion 10 is formed with a recess 19 for receiving a spring 16 (see FIG. 3). The upper end of the body portion 10 has two opposite shoulders 101 each formed with an elongated opening 11 having two opposite toothed sides for receiving an inverted U-shaped frame 20. The shoulders 101 are each formed with a dovetail groove 122 at the bottom. The inverted U-shaped frame 20 has a pair of depending legs 21 and a resilient curved cross bar 26 between the upper ends of the legs 21. Each of the legs 21 is provided at the lower end with a protuberance 25 which is adapted engage with the respective opening 11 of the body portion 10. Each leg 21 of the inverted U-shaped frame 20 has a groove 21 at the inner side. A T-shaped pressing member 22 which has a resilient curved rod at an upper portion is slidably fitted between the grooves 21 of the two legs 21 of the inverted U-shaped frame 20. The lower end of the T-shaped pressing member 22 is provided with two opposite pins 24 which are pivotally engaged with holes 151 at the upper end of a handle 14 so that the lower end of the T-shaped pressing member 22 is fitted in the upper end of the handle 14. The lower end of the T-shaped pressing member 22 may be pivotally connected with the upper end of the handle 14 by any other suitable means.

The cover 12 has two upwardly extending arms formed between with a longitudinal slot 122 which is open at the upper end. The bottom of the longitudinal slot 122 has two opposite holes 13 adapted to receive the opposite pins 141 at the lower end of the handle 14 so that the handle 14 can be rotated with respect to the cover 12. Each of the upwardly extending arms is formed with a dovetail end 121 engageable with the dovetail groove 122 of the body portion 10.

Figure 4:
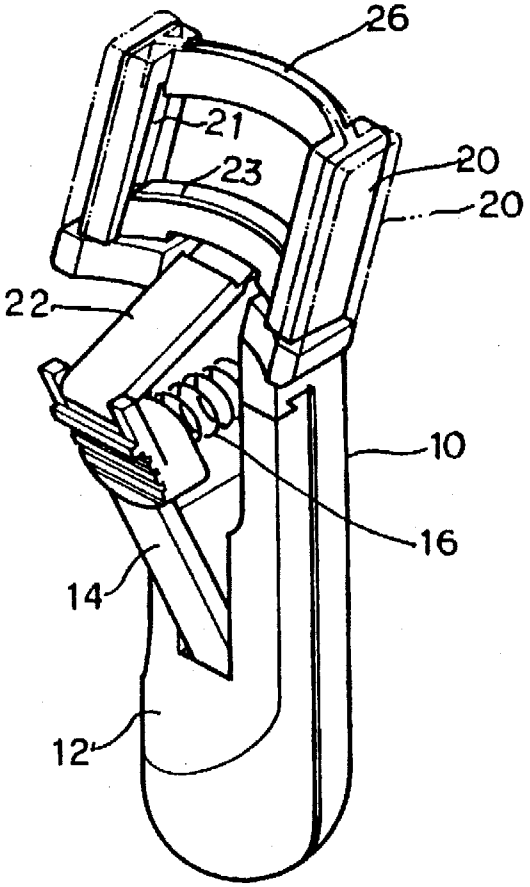
FIG. 4 is a perspective view of the eyelash curler with the inverted U-shaped frame pressed inwardly to reduce the curvature of the curved cross bar.
Figure 5:
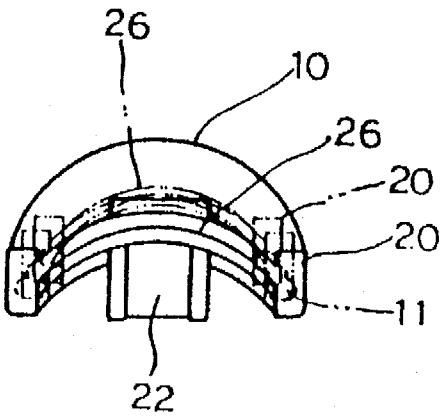
FIG. 5 illustrates how to adjust the curvature of the eyelash curler.

As shown in FIGS. 4 and 5, the frame 20 may be pressed inwardly to adjust the curvature of the resilient curved cross bar 26 and the strip 23 of the T-shaped pressing member 22.

Furthermore, the rear side of the body portion 10 is formed with a chamber 17 for storing a plurality of spare strips 23 (see FIG. 3). The chamber 17 is normally closed with a lid 18.

Figure 8:
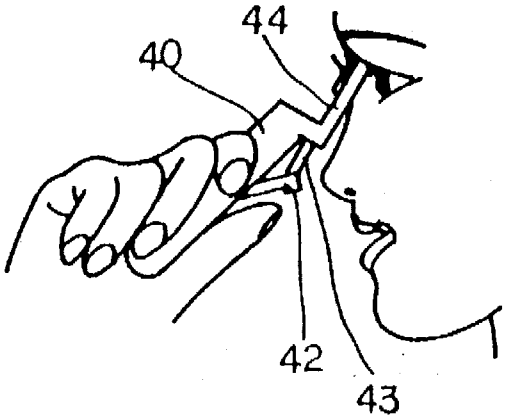
FIG. 8 is a working view of the present invention.

FIG. 8 illustrates how the eyelash curler according to the present invention works.

Figure 7:
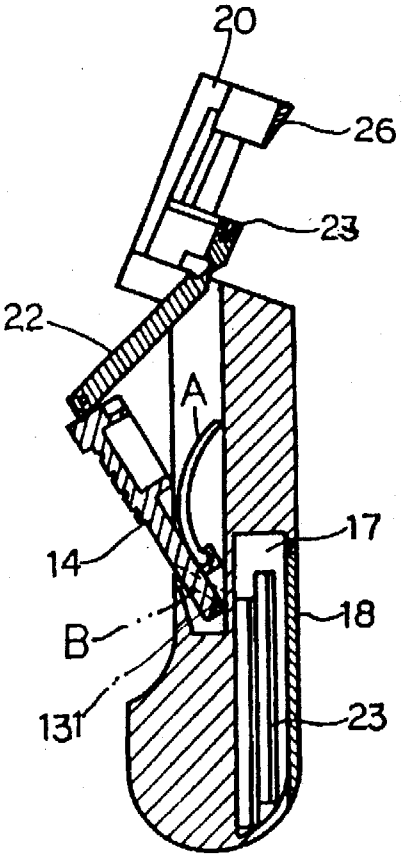
FIG. 7 is a sectional view of the second preferred embodiment of the eyelash curler.
Figure 6:
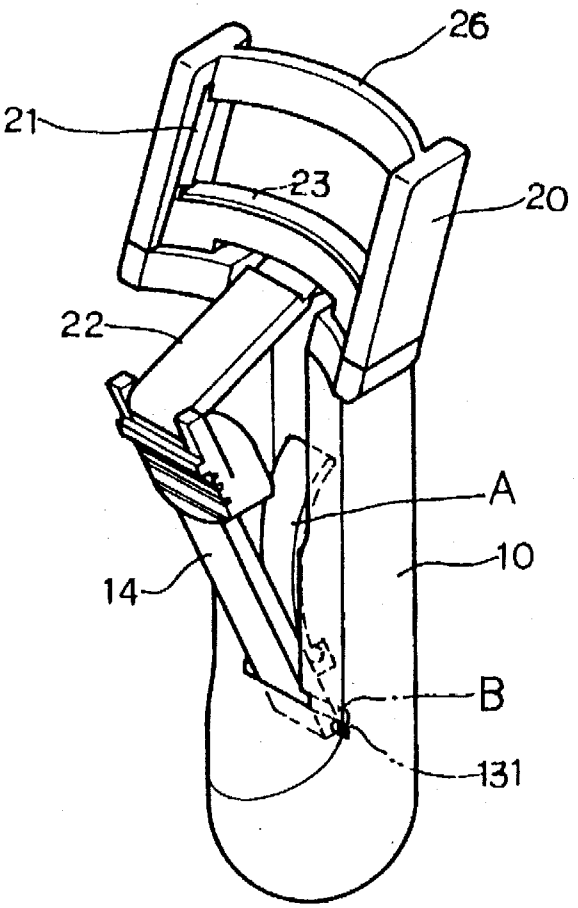
FIG. 6 illustrates a second preferred embodiment of the eyelash curler.
Figure 9:
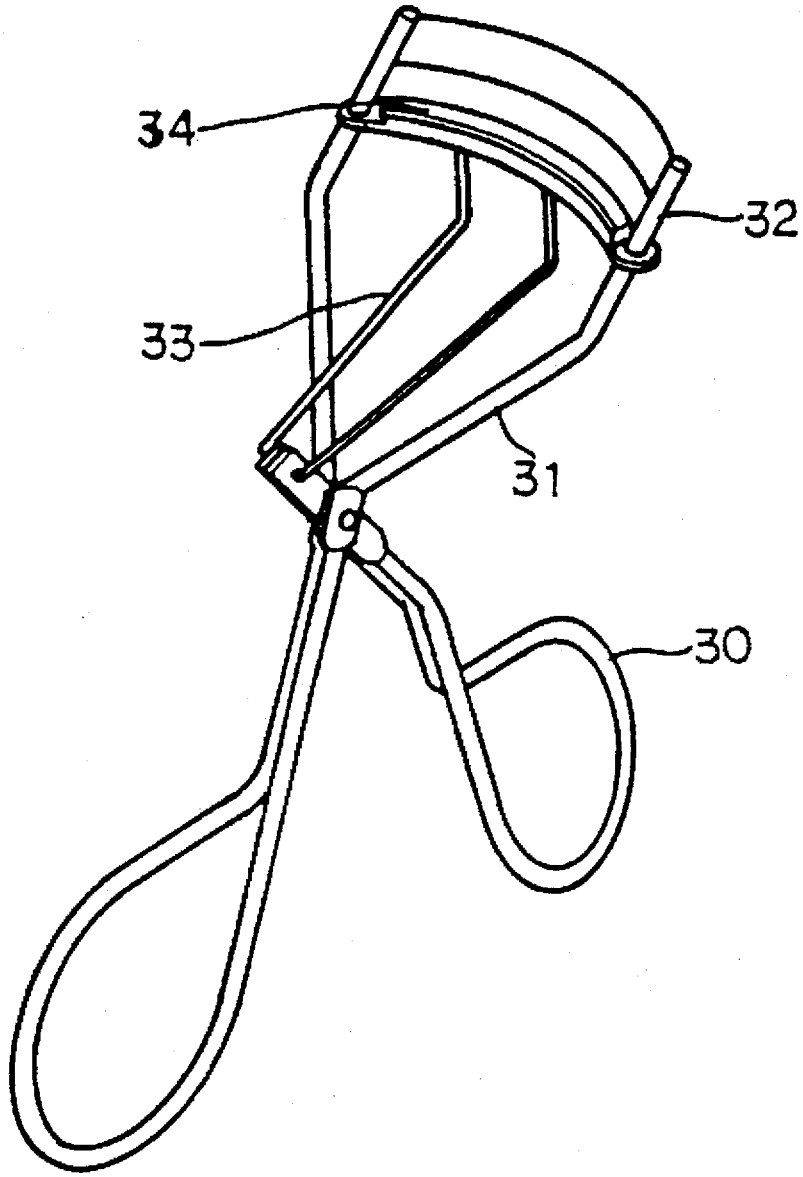
PRIOR ART FIG. 9
FIG. 9 is a perspective view of a prior art eyelash curler.

FIGS. 6 and 7 illustrate a second preferred embodiment of the eyelash curler according to the present invention. As shown, the spring 16 is replaced with a resilient plastic member A and the cover is integrally formed with the body portion 10. The cover 12 is formed with a passage B so that the handle 143 can be easily inserted into the body portion 10 thereby facilitating the assembly.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An eyelash curler comprising:

a body portion having two opposite shoulders at an upper end thereof, each said shoulder having an opening;

an inverted U-shaped frame having two depending legs and a resilient curved cross bar between upper ends of said legs, each said leg being provided with a protuberance at a lower end thereof and a groove at an inner side thereof, said protuberance being engaged with said opening;

a T-shaped pressing member having a resilient curved rod at an upper portion, said curved rod being provided with a resilient strip at a top thereof and slidably engaged with said groove of said inverted U-shaped frame;

a handle having an upper end pivotally connected with a lower end of said T-shaped pressing member;

a spring fitted in said body portion and urging against said handle; and a cover engaged with said body portion and having a pair of upwardly extending arms between which there is a slot for receiving said handle, said handle having a lower end pivotally connected with a bottom of said slot.

2. The eyelash curler as claimed in claim 1, wherein said opening is formed with two opposite toothed sides.

3. The eyelash curler as claimed in claim 1, wherein said body portion has a chamber at a rear side thereof.

4. The eyelash curler as claimed in claim 1, wherein said spring is replaced with a resilient plastic member.

5. The eyelash curler as claimed in claim 1, wherein said cover is integrally formed with said body portion.

6. The eyelash curler as claimed in claim 1, wherein said shoulders are each formed with a dovetail groove at a bottom, while said upwardly extending arms are each formed with a dovetail end engageable with said dovetailed groove.

* * * * *